United States Patent [19]

Musschoot

[11] Patent Number: 4,731,959

[45] Date of Patent: Mar. 22, 1988

[54] VIBRATORY CASTING CLEANING

[75] Inventor: Albert Musschoot, Barrington, Ill.

[73] Assignee: General Kinematics Corporation, Barrington, Ill.

[21] Appl. No.: 60,961

[22] Filed: Jun. 16, 1987

Related U.S. Application Data

[63] Continuation of Ser. No. 879,831, Jun. 26, 1986, abandoned, which is a continuation of Ser. No. 685,121, Dec. 21, 1984, abandoned.

[51] Int. Cl.[4] ..... B24C 3/30

[52] U.S. Cl. ..... 51/417; 51/423; 51/426; 51/163.1; 51/425

[58] Field of Search ..... 51/417, 422, 423, 426, 51/163.1, 313, 425

[56] References Cited

U.S. PATENT DOCUMENTS

| | | | |
|---|---|---|---|
| 2,887,826 | 5/1959 | Schultz | 51/423 |
| 3,157,004 | 11/1964 | Musschoot | 51/7 |
| 3,336,701 | 8/1967 | Moore | 51/163.1 |
| 3,793,780 | 2/1974 | Musschoot | 51/422 |
| 3,978,623 | 9/1976 | Smith | 51/163.1 |
| 3,991,524 | 11/1976 | Ferrara | 51/163.1 |
| 4,025,419 | 5/1977 | Musschoot | 51/163.1 |

FOREIGN PATENT DOCUMENTS

| | | | |
|---|---|---|---|
| 2445735 | 9/1980 | France | 51/422 |

*Primary Examiner*—Frederick R. Schmidt
*Assistant Examiner*—Robert A. Rose
*Attorney, Agent, or Firm*—Wood, Dalton, Phillips, Mason & Rowe

[57] ABSTRACT

A vibratory apparatus is provided to dislodge and separate foreign matter from castings. A curved, bottom, supporting surface for the castings is inclined downwardly towards an outlet. Vibration imparting apparatus cause individual castings to travel up the curved portion and tumble over themselves as they simultaneously advance towards the outlet. Foreign matter, separated from the castings, is diverted away from the hopper as the castings progress continuously between the inlet and the outlet in a helical path.

8 Claims, 3 Drawing Figures

Fig. 1
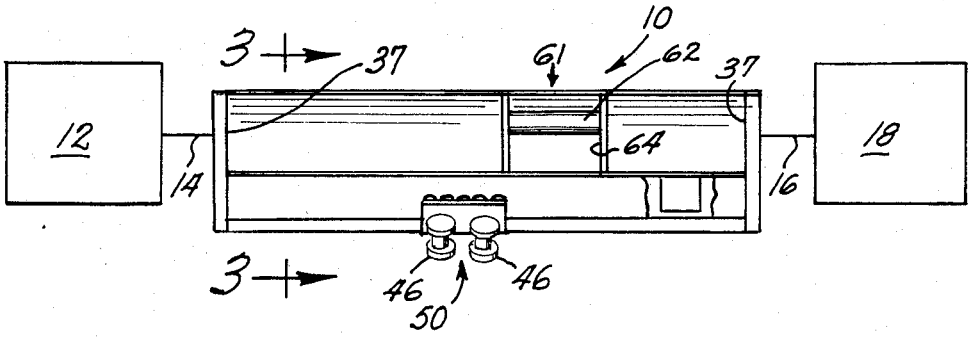
Fig. 2
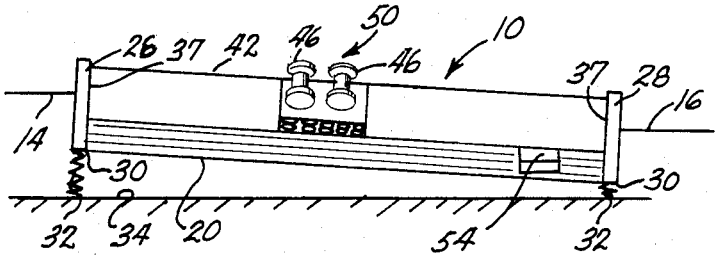
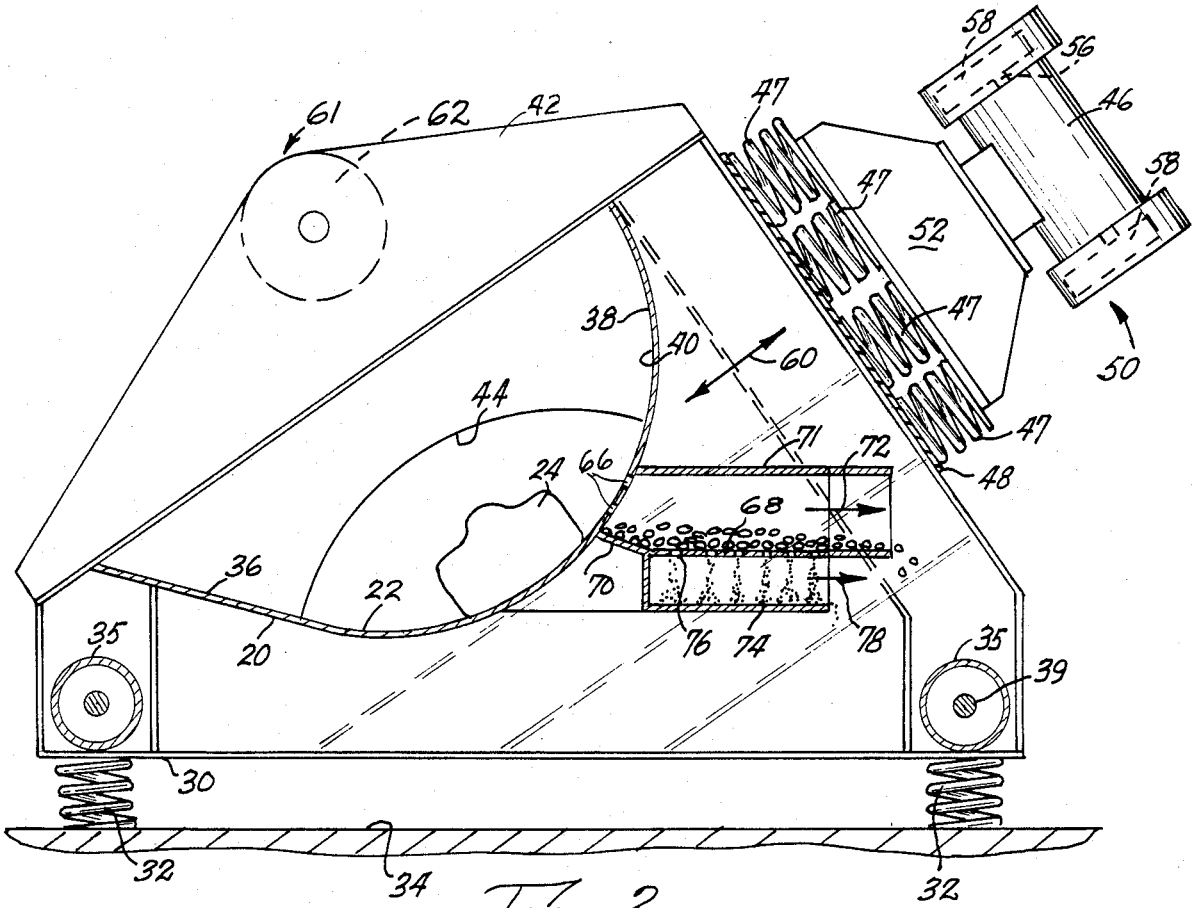
Fig. 3

VIBRATORY CASTING CLEANING

This application is a continuation of application Ser. No. 879,831 filed June 26, 1986, now abandoned, which is a file wrapper continuation of Ser. No. 685,121 filed on Dec. 21, 1984, now abandoned.

BACKGROUND OF THE INVENTION

1. Field of the Invention

This invention relates to vibratory structure for dislodging and separating sand and scale from castings.

2. Background Art

In many foundry operations, separation of sand and scale from castings is required. Typically, the castings are initially tumbled to dislodge foreign matter adhering to the castings. To assist this dislodging, shot may be caused to impinge upon the castings as they are tumbled. An exemplary structure through which dislodging of foreign matter according to the above can be accomplished is shown in U.S. Pat. No. 3,793,780 to Musschoot.

In the Musschoot U.S. Pat. No. 3,793,780 a tipped, U-shaped hopper is provided and has independently operable, vibratory imparting mechanisms associated with each leg of the hopper. Operation of the vibratory imparting mechanism is coordinated to move the casting towards a dead zone for tumbling and shot treating and away from the dead zone upon completion of the tumbling and treating operations to discharge the castings.

The principal difficulty with this type of equipment is that the vibration is not imparted continuously during the separating operation. Rather, the vibration imparting mechanisms are stopped and started, requiring monitoring and coordination. Aside from the above, the intermittent operation of the vibration imparting mechanisms results in possible excessive wear thereon.

Another drawback with the equipment in the prior art is that intermixing of the castings with the shot, the separated sand and the scale occurs. In some prior art, it is intended that sand and shot remain in the hopper with the castings as the castings are agitated and transported for discharge. The discharging castings therefore can retain some of the shot, sand and scale. In the event that engine blocks or the like are cast, complete removal of sand, scale, shot and other foreign matter is absolutely essential. Thus, with the prior art structures, a subsequent cleaning operation would have to be performed on the cast parts.

SUMMARY OF THE INVENTION

The present invention is specifically directed to overcoming the above-enumerated problems in a novel and simple manner.

According to the invention a hopper is vibrated to advance castings continuously in a path between inlet and outlet ends. Simultaneously, shot, sand, scale and other foreign matter are discharged from the hopper separately from the castings. A preliminary shake-out of the castings takes place prior to the introduction of the castings into the hopper and a subsequent abrasive removal operation takes place separately upon the castings being discharged from the hopper. Shot can be propelled at the castings in the hopper to enhance dislodging of foreign matter therefrom. Castings leaving the system are effectively cleaned of all foreign matter, i.e. shot, sand and/or scale.

BRIEF DESCRIPTION OF THE DRAWINGS

FIG. 1 is a plan view showing schematically an overall system for separating foreign matter from castings with the present invention incorporated;

FIG. 2 is a side elevation view of a continuous hopper section in the system of FIG. 1;

FIG. 3 is an enlarged sectional view of the hopper taken along line 2—2 of FIG. 1.

DETAILED DESCRIPTION OF THE DRAWINGS

In FIG. 1, a depiction of an overall system appears for loading castings into a primary separation structure 10, in which foreign matter such as scale and/or sand is dislodged from the castings, and unloading of the castings upon treatment in the primary separation structure 10 for subsequent cleaning occurs. High frequency shakeout structure is indicated at 12 and is responsible for initial breakup of mold bound castings. The castings, after initial breakup of the molds occurs, are directed to an inlet 14 for the separation structure 10 and are operated upon in a manner that will be described in detail below. The castings discharge from the separation structure 10 at an outlet 16 and are directed to a casting roll-over, abrasive removal station 18 whereat final casting cleaning is carried out.

The details of the primary separation structure, wherein the present invention resides, are shown in FIGS. 2 and 3. The primary separation structure has a hopper 20 with a bottom surface 22 for supporting the castings as they travel between the inlet and outlet ends. A typical casting 24 is shown in FIG. 3 and may be, for example, an engine block. The bottom surface 22 is supported in an inclined attitude as shown in FIG. 2 and slopes downwardly from the inlet end 14 towards the outlet end 16. The hopper 20 has attached, reinforced endwalls 26,28 with bottom surfaces 30 borne upon by isolation springs 32 interposed between the surfaces 30 and the system support surface 34. Spaced longitudinally directed tubes 35 are fit between the facing surfaces 37 of the endwalls 26,28. Coaxial tie rods 39, internally of the tubes, draw the endwalls 26,28 towards each other and against the tube ends so that a unitary assembly results. The hopper 20 is fixed captively between the endwalls 26,28.

The bottom surface 22 of the hopper has a substantially U-shaped configuration in cross section, as seen clearly in FIG. 3, and is skewed with respect to the vertical so as to define a substantially horizontal leg 36 and a vertical leg 38 having an upstanding wall surface 40. The hopper 20 is sealed by a removable hood 42 between the endwalls 26,28. The endwalls 26,28 have curved cutouts 44 (one shown) defining passages for the castings at the inlet 14 and outlet 16.

Vibration imparting structure for the hopper 20 comprises motors 46 mounted resiliently, as by coil springs 47, to an inclined exciting wall 48 carried by the hopper 20 midway between the endwalls 26,28. The disclosed arrangement is a two mass vibratory system. The exciting mass at 50 comprises the motors 46 and associated mounting base 52. The second mass comprises the hopper 20, endwalls 26,28, hood 42 and discharge section 54 which diverts separated foreign matter. Each motor 46 has a shaft 56 offset from the vertical and substantially perpendicular to the line of movement of the castings between the hopper outlet and inlet. Each shaft 56 carries a pair of eccentric weights 58 at its ends.

As the shafts 56 rotate, the hopper 20 is caused to move reciprocatively substantially along the line 60 so that conveyance of the castings 24 towards the right (FIG. 2) occurs.

The path of an exemplary casting 24 will now be described. As the motors 46 are activated, the casting follows the curvature of the bottom surface 22 and in effect begins climbing the upstanding wall 38. As the casting 24 moves vertically, gravitational forces on the casting due to the incline of the bottom surface 22 at the same time cause the casting 25 to vibrate towards the outlet 16. The casting 25 climbs until it ultimately tumbles over itself. As this operation continues, the casting 25 traces a substantially helical path. As the casting follows the described path, the foreign matter such as the scale and mold material tends to progressively dislodge.

The invention also contemplates that the separation of foreign matter be assisted by propelling shot towards the castings progressing through the structure 10 at a shot treatment station 61. A conventional wheel 62 directs shot centrifugally through an opening 64 in the hood 42. The impinging shot jolts the castings to effect separation of foreign matter that might otherwise not occur through tumbling alone.

It is a further aspect of the invention to provide structure for diverting foreign matter, separated from the castings in the hopper, away from the hopper. To accomplish this end, openings 66 are provided in the wall of the hopper. A shelf 68 resides at the openings 66 and is fed by a ramp 70 inclined downwardly away from the hopper opening 66. The vibration of the hopper tends to shift the separated foreign matter towards the shelf. The ramp and shelf vibrate in conjunction with the hopper so that the foreign matter tends in the direction of arrow 72 by the combined effect of gravity and the vibratory conveying force imparted by motor 46.

The shelf 68 resides in a chamber 71 above a floor 74 at the bottom of the chamber and has openings 76 to permit passage of a first size material which drops to the floor 74 and moves in the direction of arrow 78 to a point of collection. Material unable to pass through the shelf discharges from the upper portion of the chamber separately from the smaller size particles. By separating the foreign matter as the castings move along the length of the separating structure, the foreign matter does not find its way back into chambers and/or crevices defined by the castings or reattach to the castings. Upon exiting the separation structure, the castings are rolled over and any remaining foreign matter separated at station 18.

The foregoing detailed description was made for purposes of demonstrating the structure and operation of the invention, with no unnecessary limitations to be understood therefrom.

I claim:

1. A vibratory apparatus for separating foreign matter from castings comprising:

a hopper having an inlet for admitting the castings to the hopper, an outlet through which castings are discharged from the hopper, a longitudinal axis and a bottom surface for supporting the castings, said hopper inlet and hopper outlet being spaced from each other in a first direction, means for supporting the hopper with the bottom surface inclined a few degrees downwardly from the inlet toward the outlet;

vibration imparting means comprising at least one motor having a shaft lying in a plane extending transverse to said first direction and carrying at least one eccentric weight thereon, resilient means mounted between said vibration imparting means and said hopper for resiliently mounting said vibration imparting means to one quadrant of said hopper and for directing vibratory forces into one diametrically opposite quadrant and into one other quadrant on the same level as said opposite quadrant of said hopper for conveying castings in said first direction from the inlet to the outlet of the hopper as the castings are tumbled in a path transverse to said first direction, and means on the hopper between the hopper inlet and hopper outlet for directing foreign matter separated from the castings in the hopper away from the hopper upstream from where the castings are discharged through the outlet, whereby said castings can be continuously directed between the hopper inlet and outlet and foreign matter can be continuously separated from the castings and directed away from the hopper.

2. The vibratory apparatus according to claim 1 wherein said vibration imparting means comprises a plurality of motors, each motor having a shaft extending transverse to the horizontal axis of the hopper and carrying at least one eccentric weight whereby the vibratory force generated by said vibration imparting means is directed transversely to said first direction and into said hopper.

3. The vibratory apparatus according to claim 1 wherein said means for directing foreign matter away from the hopper comprises an opening in said hopper and a ramp at said opening inclined downwardly away from the hopper and said vibration imparting means has a force component directing foreign matter transversely to said first direction and towards the opening and the ramp.

4. The vibratory apparatus according to claim 1 wherein said bottom surface is curved in a direction transverse to the bottom surface and has an integral, upstanding wall and said vibration imparting means is attached at an upper region of said upstanding wall.

5. The vibratory apparatus according to claim 1 wherein a shot wheel is provided above said hopper upstream from said means for directing the foreign matter therefrom, said shot wheel propelling shot onto said castings as they are conveyed and tumbled from the inlet to the outlet of the hopper.

6. A vibratory apparatus for separating foreign matter from castings comprising:

a hopper having a bottom surface for supporting the castings, an inlet for admitting castings to the hopper and an outlet for discharging castings from the hopper and spaced from the inlet in a first direction, said hopper having a U-shape in cross-section transverse to said first direction with one leg of the U extending upwardly at a greater angle to horizontal than the other leg of the U, said legs each having surfaces for confining the castings in conjunction with the bottom hopper surface;

means supporting the hopper so that the bottom surface is inclined downwardly from the inlet towards the outlet;

vibration imparting means comprising at least one motor having a shaft lying in a plane extending transverse to said first direction and carrying at least one eccentric weight thereon, resilient means mounted between said vibration imparting means and said hopper for resiliently mounting said vibration imparting means to an upper quadrant of said hopper and for directing vibratory forces into both lower quadrants of said hopper for conveying castings in said first direction from the inlet to the outlet of the hopper as the castings are tumbled in a path transverse to said first direction, and means for directing foreign matter separated from the castings in the hopper away from the hopper, whereby said castings can be continuously directed between the hopper inlet and outlet and foreign matter can be continuously separated from the castings and directed away from the hopper.

7. The vibratory apparatus according to claim 6 wherein said means for directing foreign matter away from the hopper comprises an opening in said hopper between the hopper inlet and hopper outlet and an inclined ramp for directing foreign matter from said hopper to a shelf having openings allowing passage therethrough of foreign matter of a first size.

8. The vibratory apparatus according to claim 6 wherein a shot wheel is provided above said hopper upstream from said means for directing the foreign matter therefrom, said shot wheel propelling shot onto said castings as they are conveyed from the inlet to the outlet of the hopper and the means for directing the foreign matter are upstream of the hopper outlet.

* * * * *